US009074743B2

(12) United States Patent
Heim et al.

(10) Patent No.: US 9,074,743 B2
(45) Date of Patent: Jul. 7, 2015

(54) LED BASED DOWN LIGHT

(75) Inventors: Matthew Heim, Ventura, CA (US); Timothy Drew Ferrie, Ojai, CA (US); John Koteles, Oxnard, CA (US); Min Gwak, Camarillo, CA (US); Sam Fisher, Camarillo, CA (US)

(73) Assignee: The Sloan Company, Inc., Ventura, CA (US)

( * ) Notice: Subject to any disclaimer, the term of this patent is extended or adjusted under 35 U.S.C. 154(b) by 455 days.

(21) Appl. No.: 13/402,665

(22) Filed: Feb. 22, 2012

(65) Prior Publication Data

US 2013/0051017 A1 Feb. 28, 2013

Related U.S. Application Data

(60) Provisional application No. 61/445,989, filed on Feb. 23, 2011.

(51) Int. Cl.

| | |
|---|---|
| ***F21V 7/00*** | (2006.01) |
| ***F21S 8/04*** | (2006.01) |
| *F21V 23/04* | (2006.01) |
| *F21Y 101/02* | (2006.01) |
| *F21Y 105/00* | (2006.01) |

(52) U.S. Cl.

CPC ..... *F21S 8/04* (2013.01); *F21V 7/0083* (2013.01); *F21V 23/0442* (2013.01); *F21Y 2101/02* (2013.01); *F21Y 2105/001* (2013.01)

(58) Field of Classification Search

USPC ..... 362/227, 235, 247, 296.01, 297

See application file for complete search history.

(56) References Cited

U.S. PATENT DOCUMENTS

| | | | | |
|---|---|---|---|---|
| 2002/0093820 | A1* | 7/2002 | Pederson | 362/241 |
| 2005/0116667 | A1 | 6/2005 | Mueller et al. | |
| 2007/0211473 | A1* | 9/2007 | Peck | 362/341 |
| 2008/0212319 | A1* | 9/2008 | Klipstein | 362/231 |
| 2010/0038657 | A1 | 2/2010 | Higuchi et al. | |

FOREIGN PATENT DOCUMENTS

WO WO2009002026 A2 12/2008

OTHER PUBLICATIONS

Invitation to Pay Additional Fees and, Where Applicable, Protest Fee from corresponding PCT application PCT/US2012/026296 dated May 24, 2012.

* cited by examiner

*Primary Examiner* — Meghan Dunwiddie

(74) *Attorney, Agent, or Firm* — Koppel, Patrick, Heybl & Philpott

(57) ABSTRACT

A lighting assembly comprising a housing including a front surface and a back surface, a plurality of light emitting elements on a printed circuit board (PCB) within said housing, and a reflector proximate the light emitting elements. The reflector comprises a plurality of reflective cups, wherein each reflective cup is configured to receive a respective light emitting element. The reflector is adapted to reflect light emitted from the plurality of light emitting elements in accordance with a desired light distribution pattern.

41 Claims, 4 Drawing Sheets

FIG. 2a
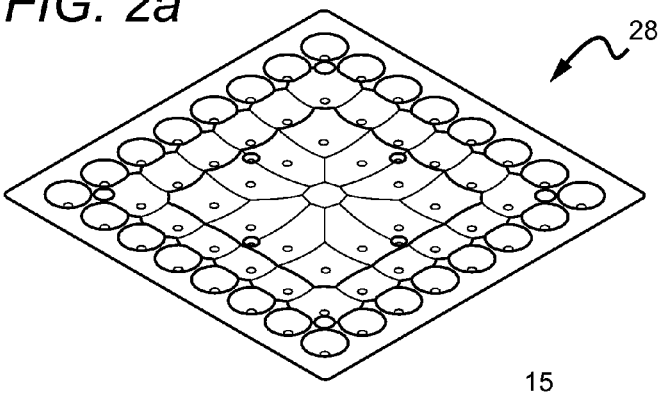
FIG. 2b
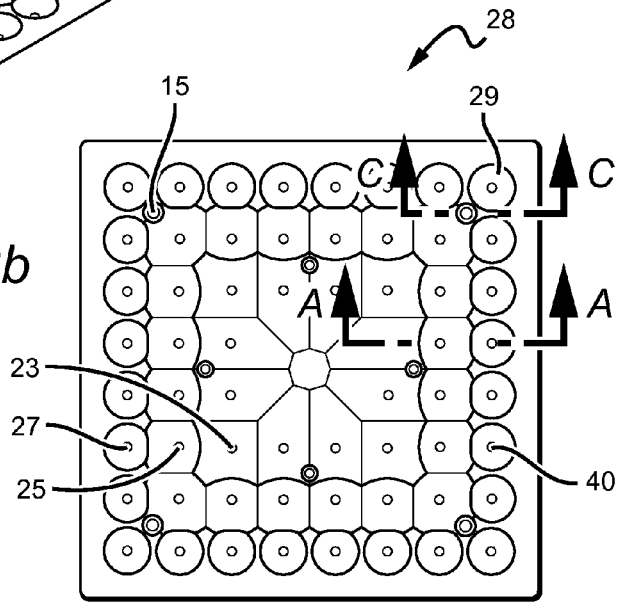
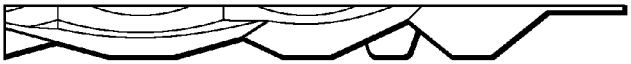
FIG. 2c
FIG. 2d
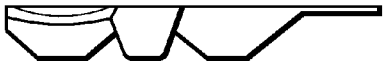
FIG. 2e
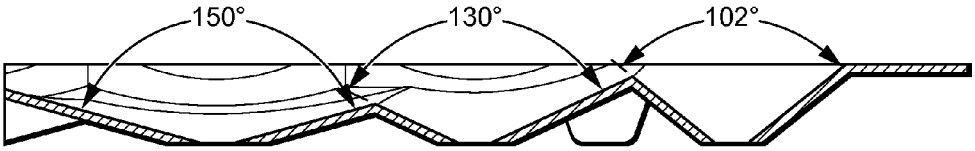

LED BASED DOWN LIGHT

RELATED APPLICATIONS

This application claims the benefit of priority of U.S. Provisional Application Ser. No. 61/445,989, filed on Feb. 23, 2011.

BACKGROUND OF THE INVENTION

1. Field of the Invention

This invention relates to a light emitting device assembly, such as a downward facing light assembly, which is well suited for use with solid state lighting sources, such as light emitting diodes (LEDs).

2. Description of the Related Art

Lighting fixtures are ever-present in residential, commercial and industrial spaces throughout the world. In many instances the lighting fixtures, for example troffer fixtures, are mounted to or suspended from ceilings, or even recessed into the ceiling and house elongated fluorescent light bulbs that span the length of the troffer. For ceiling-recessed troffers, the back side of the troffer extends into the plenum space above the ceiling. The troffer fixture can include elements to dissipate heat generated by the light source into the ambient. Ceiling recessed troffers dissipate heat from the light source into the plenum area above the ceiling where air can be circulated to facilitate the cooling mechanism.

In yet other instances, the down lighting fixtures can be mounted to a pole or canopy in an outdoor setting. The outdoor pole mounted fixtures, such as a floodlight, are broad-beamed high intensity lights that are often used to illuminate an outdoor area. Light fixtures in an outdoor setting are exposed to the environment and must have a weather-proofed housing that protects the light source housed within the housing. Outdoor canopy mounted lighting fixtures are commonly used as a lighting solution for parking garages, parking lots, gas stations and many other outdoor settings. The down light fixtures are typically constructed of aluminum or plastic housing having a box-like shape. The housing also has an opening covered by a clear or translucent cover or lens that transmits light emitted from the light source housed within the housing and a reflector to reflect emitted light towards the cover or lens. Typical light sources used for down lights are neon, fluorescent, metal halide or incandescent lights.

Various types of lighting fixtures are used with different types of light sources, such as incandescent bulbs, fluorescent tubes or metal halide. One of the problems associated with the conventional lighting units is that their light sources can experience relatively low electrical efficiency. In order to provide sufficient lighting, especially in large lighting applications, conventional lights are required to consume a significant amount of energy. For example, a standard fluorescent tube 60 inches in length consumes as much as 60 to 70 Watts, and conventional light fixtures can utilize many of these tubes. Also, typical metal halide fixtures consume as much as 400 Watts.

More recently, with the advent of the efficient solid state lighting sources, these lighting fixtures have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with a vast majority of the electricity they consume being released as heat rather than light. Fluorescent light bulbs are more energy efficient than incandescent light bulbs, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1,000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

SUMMARY

The invention provides various embodiments of a lighting assembly that is efficient, reliable, cost effective and can be arranged to provide a down-light lighting scheme. The different embodiments comprise elements to alter or control the light distribution pattern emitted from the light sources within the lighting assembly. The light altering elements can comprise many different materials or devices arranged in different ways, with some devices comprising a reflector. The invention is also configured such that the lighting assembly can be easily installed by a single individual.

In one embodiment, as broadly described herein, a lighting assembly comprises a housing including a front surface and back surface, a plurality of light emitting elements, a printed circuit board (PCB) mounted within the housing wherein the plurality of light emitting elements are mounted on the PCB. The assembly further comprises conductors to provide an electrical current to each of said light emitting elements, and a reflector placed adjacent light emitting elements, wherein the reflector has a plurality of reflector cups arranged in a plurality of reflective patterns to reflect light emitted from the light emitting elements in a desired light distribution pattern. The light emitting elements are adapted to emit light in a direction away from said housing, in response to the electrical current supplied by the conductors. The lighting assembly further comprises a mounting mechanism for mounting said assembly to a structure.

In another embodiment, the lighting assembly comprises a housing including a back surface and a light emitting surface, a plurality of light emitting elements mounted on a PCB within said housing, heat sinks to dissipate heat from the light emitting elements, and a reflector placed over the light emitting elements, wherein the reflector has a plurality of reflector cups. The reflector cups are adapted to receive a respective one of the light emitting elements. The reflector can be configured to include differently sized reflector cups, in order to control the light distribution pattern emitted from the lighting assembly.

These and other aspects and advantages of the invention will become apparent from the following detailed description and the accompanying drawings which illustrate by way of example the features of the invention.

BRIEF DESCRIPTION OF THE DRAWINGS

FIG. 2*a* is a perspective view of a reflector of a lighting assembly according to an embodiment of the invention.

FIG. 2*b* is an overhead view of the reflector of FIG. 2*a*.

FIG. 2*c* is a cross-sectional view of the reflector of FIG. 2*b* along the line A-A.

FIG. 2*d* is a cross-sectional view of the reflector of FIG. 2*b* along the line C-C.

FIG. 2*e* is a cross-sectional view of a reflector of a lighting assembly according to an embodiment of the invention.

DETAILED DESCRIPTION

Figure 1A:
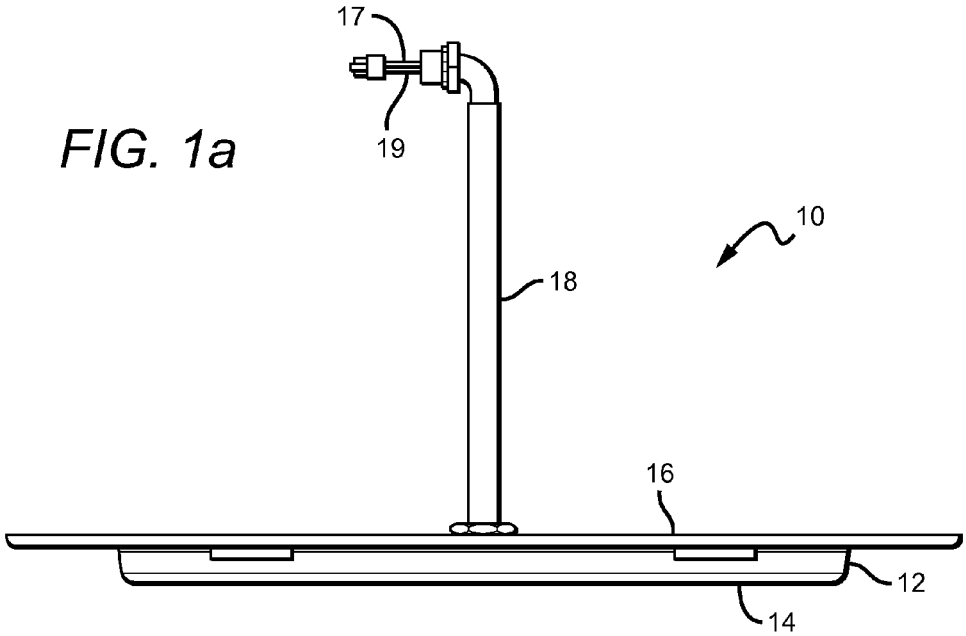
FIG. 1*a* is a perspective view of a lighting assembly according to an embodiment of the invention.

The invention described herein is directed to different embodiments of a lighting assembly that in some embodiments provides a reflective element adapted to modify the radiation pattern of light emitted from the lighting assembly. The lighting assembly can comprise many different materials and can be used in many different lighting applications such as, but not limited to, structural lighting, display lighting and ingress/egress lighting. The lighting assembly according to the present invention can be arranged in many different ways with many different components, and is generally arranged to provide a downward facing lighting solution. In some embodiments, the lighting assembly can comprise a housing including a top surface opposite a back surface, a PCB mounted within the housing, a plurality of light emitting elements mounted on the PCB and conductors electrically connected to the plurality of light emitting elements to provide an electrical signal to each of the light emitting elements. The lighting assembly further comprises a reflective element positioned adjacent the plurality of light emitting elements, such that substantially all light emitted from the light emitting elements is directed towards the light emitting surface of the housing. The housing can also comprise heat sinks in thermal contact with the plurality of light emitting elements to conduct heat from the light emitting elements and efficiently radiate the heat into the ambient. In some embodiments the housing is made of thermally conductive materials such that the housing further assists in the dissipation of heat. This arrangement allows the light emitting elements to operate at a lower temperature which could extend the operational lifetime of the light emitting elements. The heat sinks and/or the housing dissipating heat from the assembly could reduce the need of an active cooling system, thereby reducing manufacturing costs. However, in other embodiments, an active cooling system could be present to assist in the dissipation of heat.

Downward facing light assemblies are generally known in the art and are typically used to illuminate areas directly below the downward facing light assemblies. Conventional downward facing light assemblies can comprise a housing, a light source, electronic components to power the light source and a lens or transparent cover to protect the light source. Typical light sources for these conventional assemblies are, for example, incandescent, neon or fluorescent bulbs. These assemblies are normally mounted to a ceiling, a canopy or a pole, whereas other conventional assemblies can be recessed into the ceiling or canopy such that the electronic components of the housing are within the ceiling or canopy and the lens or transparent cover is exposed. However, in either instance, these assemblies can be big and bulky due to the physical dimensions of the necessary high power electronic components and the size of the light source. As such, the profile of the conventional assembly mounted or recessed in the ceiling or canopy can extend from the ceiling or canopy such that the assembly is not aesthetically pleasing. Additionally, these assemblies can also have a reflector to reflect any backward emitted light out the assembly. However, the light emitted from the conventional assembly is concentrated to an area directly below the assembly such that there is a stark drop-off of light at the edge of the illuminated area.

The lighting assembly of the present invention can provide a number of additional advantages beyond those mentioned above. For example, in some embodiments the light emitting elements of the lighting assembly are LEDs, which are physically smaller than fluorescent and incandescent bulbs typically used in the conventional assemblies, thereby reducing the profile of the lighting assembly. Additionally, LEDs operate at a lower power level in comparison to fluorescent and incandescent bulbs and do not need similar high power electronic components, leading to smaller electronic components, a reduction in size of the housing and overall weight of the assembly. As such, installation of the lighting assembly according to the invention can be performed by one person, whereas installation of a conventional assembly typically requires two people due in part to the weight of assembly.

Some embodiments of the lighting assembly according to the invention can be used to provide a down-light solution in any setting, such as a parking lot or gas station. However, the invention is not intended to be limited to such embodiments. As further described below, the lighting assembly can be configured to allow a single individual to easily install the lighting assembly.

The invention is described herein with reference to certain embodiments, but it is understood that the invention can be embodied in many different forms and should not be construed as limited to the embodiments set forth herein. In particular, the present invention is described below in regards to certain lighting components having LEDs, LED chips or LED components in different configurations, but it is understood that the invention can be used for many other assemblies having many different configurations. The components can have different shapes and sizes beyond those shown and different numbers of LEDs or LED chips can be included.

It is to be understood that when an element or component is referred to as being "on" another element or component, it can be directly on the other element or intervening elements may also be present. Furthermore, relative terms such as "between", "within", "adjacent", "below", "proximate" and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

Embodiments of the invention are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

With reference to FIGS. 1*a*-1*d*, an exemplary lighting assembly 10 is shown. In some embodiments the lighting assembly 10 comprises a housing 12 including a front surface 14 and a back surface 16 opposite the front surface 14, a plurality of light emitting elements 23, 25, 27 (discussed below) mounted within the housing 12, and first and second electrical conductors 17, 19 in electrical communication with the plurality of light emitting elements 23, 25, 27, such that each of the light emitting elements 23, 25, 27 emit light in response to an electrical signal from the first and second electrical conductors 17, 19. The back surface 16 of the housing 12 is adapted to receive a conduit 18 which houses the first and second electrical conductors 17, 19. In some embodiments the lighting assembly 10 is configured to be recessed mounted into a ceiling or canopy such that the front surface 14 of the housing 12 is downward facing to provide a down-light lighting scheme. In other embodiments the lighting assembly 10 can be surface mounted to the ceiling or canopy, while in other embodiments, the lighting assembly 10 can be mounted in the housing of an existing light fixture. In yet other embodiments, the lighting assembly 10 can be mounted to a pole or other stand-alone structures.

The lighting assembly 10 can further comprise a translucent or transparent cover 20 coupled to the front surface 14 of the housing 12. The cover 20 can be formed of plastic, tempered glass or the like. In embodiments where a translucent cover 20 is utilized, the light emitted from the light emitting elements 23, 25, 27 can be diffused by the translucent cover 20 and/or by the features of the light emitting elements 23, 25, 27 to give the appearance that the lighting assembly 10 is a continuous light source.

Figure 1B:
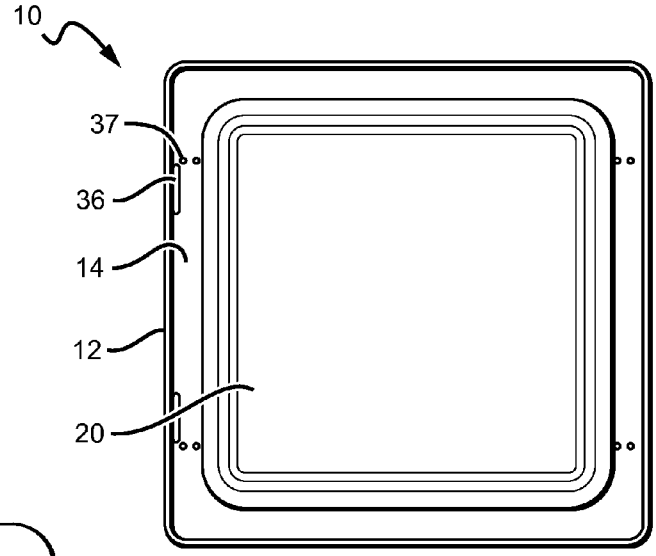
FIG. 1*b* is an overhead view of the lighting assembly of FIG. 1*a*.
Figure 1C:
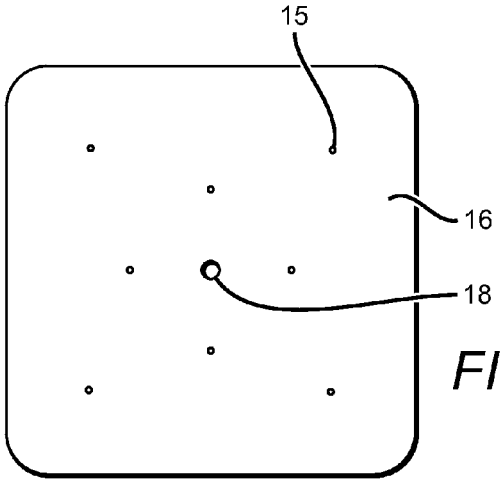
FIG. 1*c* is an elevated view of the lighting assembly of FIG. 1*a*.
Figure 1D:
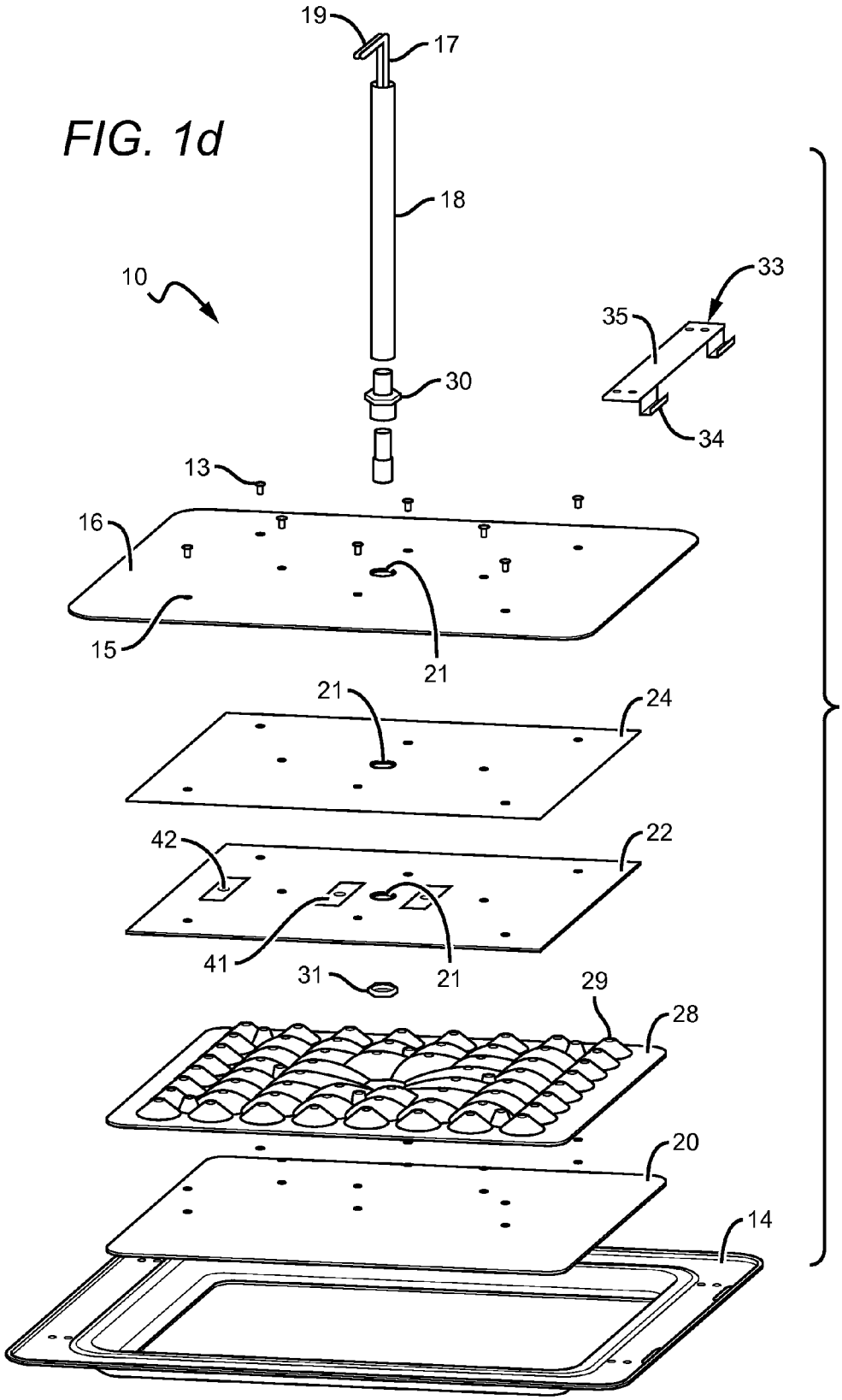
FIG. 1*d* is an exploded view of the lighting assembly according to an embodiment of the invention.

FIG. 1*d* shows an exploded view of an embodiment of the lighting assembly 10 according to the invention, and discloses additional components that may be included in the lighting assembly 10. For the same or similar elements or features, the same reference numbers will be used throughout the application herein. The lighting assembly 10 further comprises a PCB 22 mounted within the housing 12 and has at least, first, second and third light emitting elements 23, 25, 27 mounted onto the PCB 22. The first and second conductors 17, 19 can be mounted or connected to the PCB 22 in order to provide an electrical signal to the light emitting elements 23, 25, 27. Many different connection methods can be used, with one suitable method being soldering or using insulation-displacement connectors (IDC) or insulation-piercing connectors (IPC). The conductors 17, 19 can be mounted and connected on either side of the PCB 22. The PCB 22 can also comprise conductive traces to conduct electrical signals from the conductors 17, 19 to the light emitting elements 23, 25, 27 so that an electrical signal applied to the first and second conductors 17, 19 is conducted to the light emitting elements 23, 25, 27 through the traces, causing the light emitting elements 23, 25, 27 to emit light.

The PCB 22 can be made of flexible material, rigid material, or any other suitable PCB material known in the art. In other embodiments, the PCB 22 can be formed of different types of flexible boards, such as but not limited to alternating layers of polyimide film and copper. In some embodiments, an insulation sheet 24 can be included in the housing 12 behind the PCB 22, opposite the light emitting elements 23, 25, 27, such that insulation sheet 24 is interposed between the PCB 22 and the back surface 16 of the housing 12. The insulation sheet 24 can be formed of any suitable electrically insulating material. In operation, heat from the light emitting elements 23, 25, 27 is conducted into the PCB 22 such that the PCB 22 helps draw away heat from the light emitting elements 23, 25, 27. The PCB provides a larger surface area that allows the heat to dissipate into the surrounding ambient. This configuration assists the light emitting elements 23, 25, 27 in maintaining a cool operational temperature, thereby allowing the light emitting elements 23, 25, 27 to operate at a higher current so that they can emit a higher luminous flux. An advantage of the invention is that the operational lifetime of the light emitting elements 23, 25, 27 may be extended when operating at a cooler temperature.

In an embodiment of the invention wherein the PCB 22 is constructed of alternating layers of polyimide film and copper, heat from the light emitting elements 23, 25, 27 is conducted into the PCB 22 and the copper layers would facilitate the heat dissipation during operation of the lighting assembly 10. Thermal vias may also be added to the multi-layered PCB 22 proximate the light emitting elements 23, 25, 27, wherein the thermal vias are in thermal contact with the copper layers of the PCB 22 to allow for a more efficient heat transfer. Thermal vias may also be added to PCBs 22 that are made of other materials.

The lighting assembly 10 further comprises a reflector 28 disposed between the PCB 22 and the cover 20. The reflector 28 has a plurality of reflective cups 29, wherein each of the reflective cups 29 are adapted to receive a respective one of the light emitting elements 23, 25, 27. The reflector 28 can be configured to be an individual body having a plurality of reflective cups 29. In other embodiments, the reflector 28 can be configured as a plurality of individual reflectors, with each reflector comprising a reflective cup 29.

The back surface 16, insulation sheet 24 and PCB 22 each comprise an opening 21 to receive the conductors 17, 19 in order to electrically connect the conductors 17, 19 to the light emitting elements 23, 25, 27. The openings 21 of the back surface 16, insulation sheet 24 and PCB 22 are aligned for ease of manufacturing. In some embodiments, the conduit 18 is coupled to a coupler 30 and the coupler 30 extends into the housing 12 through the opening 21 of each of the back surface 16, insulation sheet 24 and PCB 22, such that the coupler 30 extends beyond the surface of the PCB 22. A nut 31 or similar attachment device is fastened to the coupler 30 in order to secure the PCB 22, insulation sheet 24 and back surface 16 to each other. In addition, each of the back surface 16, insulation sheet 24, PCB 22 and reflector 28 comprise a plurality of mounting holes 15 adapted to receive a mounting screw 13, nail, rivet, or the like, such that the mounting screw 13 extends into the housing 12 through the mounting holes 15 of each of the back surface 16, insulation sheet 24 and PCB 22, such that the mounting screw 13 is received by the mounting hole 15 of the reflector 28. The mounting screws 13 properly secure the reflector 28 to the PCB 22, such that the positioning of the reflector 28 is maintained in relation to the light emitting elements 23, 25, 27. The embodiment of the invention in FIGS. 1*c* and 1*d* disclose that there are eight mounting holes 15, however the invention is not intended to be limited to only eight mounting holes 15; other embodiments could have more or less mounting holes 15 and respective mounting screws 13.

The cover 20 and front surface 14 of the housing 12 can be positioned adjacent the reflector 28 such that the back surface 16 and the front surface 14 can be joined together to form the fully assembled lighting assembly 10. As shown in FIG. 1*b*, the lighting assembly 10 is configured such that substantially all light is emitted out of the housing 12 through the cover 20. In some embodiments, the cover 20 is coupled to the front surface 14 using double sided tape, waterproof breathing filters, thermoplastic hotmelts, or any other suitable sealant in order to form a weather-proof seal around the housing to protect the internal components of the assembly 10. Sealant can also be applied to the area where the front surface 14 and back surface 16 are joined together when assembling the lighting assembly 10. The weather-proof seal of the housing 12 also prevents contaminants, such as but not limited to, dirt, smoke, soot and the like, from entering the housing 12. An advantage of the invention is that the lighting assembly 10 has an added rigidity or ruggedness when the sealant is utilized. The housing 12 can be made of many different materials, such as conductive, semi-conductive, non-conductive materials or a combination thereof. In other embodiments, the housing 12 is formed of plastic and can be made using many known processes such as injection molding or extrusion. In yet other embodiments, the housing 12 can be made of metal.

FIGS. 2*a*-2*e* show an embodiment of the light assembly 10 in more detail and shown from different angles. The light emitting elements 23, 25, 27 are mounted to the PCB 22 and the reflector 28 comprising a plurality of reflector openings 40 is aligned with the light emitting elements 23, 25, 27 such that each of the plurality of reflective cups 29 of the reflector 28 receives a respective one of the light emitting elements 23, 25, 27. The reflective cups 29 are cone-like cavities that reflect light emitted from the light emitting elements 23, 25, 27 toward the front surface 14 of the housing. The reflective cups 29 can have many different shapes, such as but not limited to cylindrical, hemi-spherical, parabolic, and the like. In yet other embodiments, the reflective cups 29 can be multi-faceted. In some embodiments of the invention, the reflector 28 reflects light emitted from the light emitting elements 23, 25, 27 in the same manner. In other embodiments, as shown in FIGS. 2*a*-2*e*, the reflective cups 29 are configured in a progressive manner such that the reflector 28 is a progressive reflector 28.

The progressive reflector 28 can be configured to have a number of different patterns of reflective cups 29, wherein the patterns of the reflective cups 29 are varied as they approach the center of the progressive reflector 28. FIG. 2*b* discloses an exemplary progressive reflector 28 wherein each of the light emitting elements 23, 25, 27 are disposed in different concentric patterns of reflective cups 29, wherein the concentric patterns of the reflective cups 29 have different dimensions. Each of the reflective cups 29 in a particular concentric pattern are configured to have the same or similar dimensions. In one embodiment, the reflective cups 29 on the innermost region of the progressive reflector 28 have a wider shape and a wider opening angle which allows the light emitted from the light emitting element 23 to be reflected out the lighting assembly 10 in a wide light distribution pattern to illuminate a wider area. The width of the opening angle of the other patterns of reflective cups 29, progressing outward from the innermost region, become progressively narrower which results in a narrower light output of reflected light. The outermost pattern of reflective cups 29 have a narrow light distribution pattern and reflect light in a more downward direction than the other patterns of reflective cups 29. The configuration of the progressive reflector 28 allows the lighting assembly 10 to have a light distribution pattern that provides a wider area of illumination as well as a gradual drop off of illumination at the edges of the illuminated area. As discussed above, conventional light fixtures have a light output in a substantially downward direction which produces a light distribution having a harsh cut-off of light at the edge of the illuminated area.

FIG. 2*b* shows the reflective cups 29 arranged in a concentric pattern about the center of the progressive reflector 28. However, the invention is not intended to be limited to such an arrangement. In other embodiments, the patterns of the reflective cups 29 can be arranged in many different ways, such as but not limited to linearly or randomly distributed, and do not need to be positioned in relation to a central point or region of the progressive reflector 28. In yet other embodiments, the reflective cups 29 in a particular pattern can have different dimensions.

In one embodiment of the invention, as shown in FIG. 2*e*, the innermost pattern of reflective cups 29 have an opening angle of 150 degrees, the next pattern of reflective cups 29 have an opening angle of 130 degrees and the outer most pattern of reflective cups 29 have an opening angle of 102 degrees. However, in other embodiments these angles may vary both being larger and smaller than the above-listed embodiment; any angle from 1 degree to 180 degrees can be used. A number of factors can contribute to determine the opening angles of the reflective cups 29, for example, the distance of the lighting assembly 10 to the surface to be illuminated or desired area of illumination, number of light emitting elements and spacing between the light emitting elements, or the amount of light overlap required by each lighting emitting element. The light emitting elements 23, 25, 27 and progressive reflector 28 are configured such that there is sufficient overlap of emitted light from the light emitting elements 23, 25, 27 and the progressive reflector 28 to produce an even light distribution having a gradual drop off of light at the outer end of the light distribution.

In some embodiments, the light emitting elements 23, 25, 27 can be mounted on the PCB 22 such that they are perpendicular to the PCB 22, at an angle, substantially parallel to the PCB 22 or a combination thereof. The arrangement of the light emitting elements 23, 25, 27 on the PCB 22 influences the radiation pattern of the light emitted from the lighting assembly 10. As such, the positioning of the light emitting elements 23, 25, 27 can be used to alter or modify the radiation pattern to yield a desired radiation pattern. The light emitting elements 23, 25, 27 are generally mounted in a concentric pattern on the PCB 22. However, in other embodiments the light emitting elements 23, 25, 27 can be mounted in other patterns, such as linearly or even randomly. In other embodiments the lighting assembly 10 can comprise any number of light emitting elements 23, 25, 27 mounted as indicated herein. The light emitting elements 23, 25, 27 can be any device that emits light in response to an electrical signal, such as incandescent lights, lasers, laser diodes, fluorescent light, neon lights or LEDs. The light emitting elements 23, 25, 27 can emit different colors of light at different intensities. One suitable LED would have an output of 150 lumens per Watt, while other suitable LEDs could have an output that is higher or lower.

The lighting assembly 10, according to an embodiment of the invention, can comprise additional elements with one embodiment comprising heat sinks 41 to dissipate heat away from the light emitting elements 23, 25, 27. The heat sinks 41 may be placed on the PCB 22 opposite the light emitting elements, or disposed within the housing 12 in proximity to or adjacent the back surface 16. Also, thermal vias 42, in thermal communication with the heat sinks 41, may be placed within the PCB 22 near the light emitting elements 23, 25, 27 and plated with copper or any other thermally conductive material to help dissipate heat and guide the heat towards the heat sinks.

The lighting assembly 10 further comprises a power supply (not shown) electrically connected to conductors 17, 19. Power supplies are generally known in the art and are only discussed briefly herein. In one embodiment, the power supply is adapted to provide a constant current output. The power supply provides substantially the same drive current to the light emitting elements 23, 25, 27 so that the lighting assembly 10 can emit a substantially constant light distribution pattern in accordance with the desired light emission. In some embodiments, the power supply can be installed remote to the lighting assembly 10, whereas in other embodiments, the power supply can be mounted on or within the housing 12. At least one advantage of the invention is that the power supply, while in operation, allows the lighting assembly 10 to provide and maintain the desired light output and prevents the lighting assembly 10 from exhibiting an undesirable light output, such as but not limited to different levels of light brightness, color variations or variations in the light distribution pattern. In yet other embodiments, the lighting assembly 10 can comprise constant current drive circuitry electrically connected to the power supply in order to provide the same drive current to the light emitting elements 23, 25, 27.

The lighting assembly 10 can be mounted to a mounting surface or an underside of a canopy or similar downward facing surface. Many different methods can be used to mount the lighting assembly 10 to a mounting surface, such as by glue, clamp, bolt, weld, rivet, screw, bracket and the like. In one such method, the lighting assembly 10 can be provided with double-sided tape on the back surface 16 in order to mount the lighting assembly 10 to a mounting surface. Many different double-sided tapes can be used, with a suitable tape being a commercially available double-sided foam tape provided by 3M Corporation in St. Paul, Minn. In another embodiment of the invention, the lighting assembly 10 can be provided with an alternative mounting method that can be used alone or in conjunction with the double-sided tape. As shown in FIG. 1*b*, the housing 12 comprises a plurality of housing mounting holes through which a screw, nail or rivet can pass through to mount the housing 12 to the mounting surface. The components within the housing 12 may also comprise mounting holes in alignment with a respective housing mounting hole 37.

In other embodiments of the invention, a mounting bracket 33 can be used to mount the lighting assembly 10 to the mounting surface. The mounting bracket 33 has a longitudinal planar surface 35 and at least one hinge extension 34 extending perpendicularly from the planar surface 35.

To install the lighting assembly 10, the mounting bracket 33 is first attached to the mounting surface, such that the at least one hinge extension 34 extends away from the mounting surface. Next, as shown in FIG. 3*a*, the lighting assembly 10 is hooked onto the mounting bracket 33 such that the lighting assembly 10 is hanging from the at least one hinge extension 34 of the mounting bracket 33. The front surface 14 of the housing 12 comprises one or more slots 36 configured to receive the at least one hinge extension 34 of the mounting bracket 33. Hanging the lighting assembly 10 from the hinge extension 34 allows the electrical wiring or any other components of the lighting assembly 10 to be connected or passed up through the mounting surface. After this, the lighting assembly 10 can be pivoted about the hinge extension 34 towards the mounting surface such that the back surface 16 of the housing 12 contacts the mounting surface.

Figure 3B:
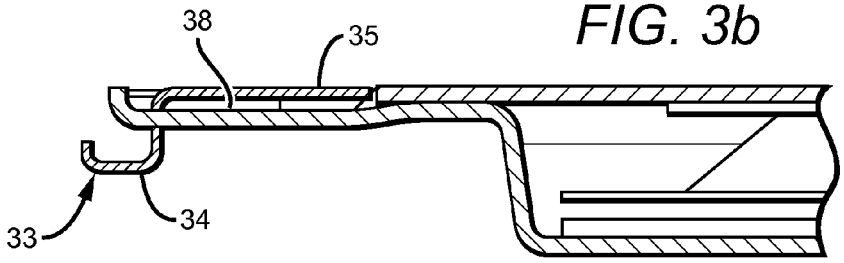
FIG. 3*b* is a cross-sectional view of a lighting assembly according to an embodiment of the invention.
Figure 3A:
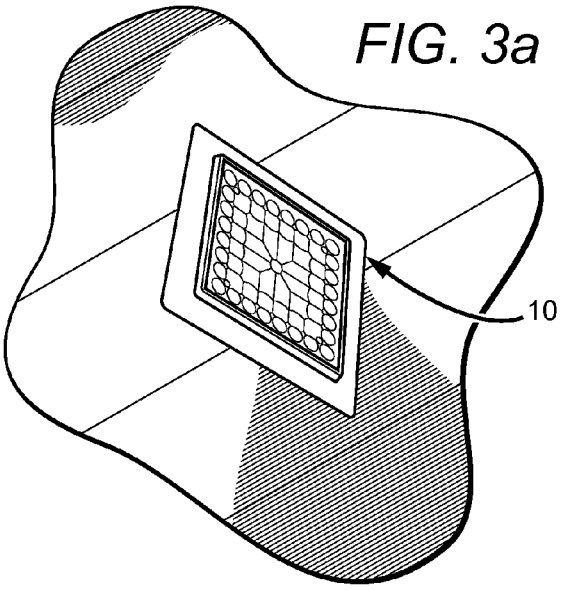
FIG. 3*a* is a perspective view of a lighting assembly according to an embodiment of the invention.
Figure 3C:
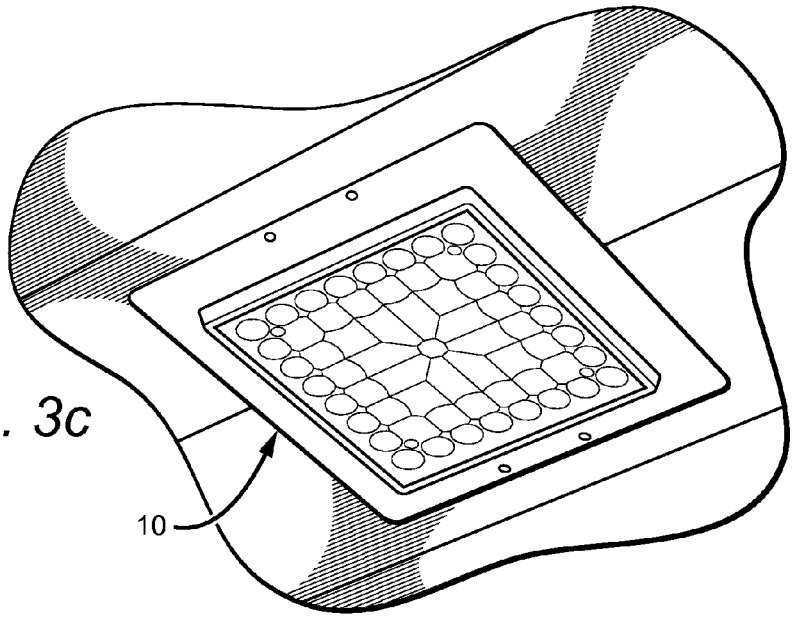
FIG. 3*c* is a perspective view of a lighting assembly according to an embodiment of the invention.

As shown in FIG. 3*b*, the lighting assembly 10 has an indentation 38 to accommodate for the planar surface 35 of the hanger bracket 33, such that the planar surface 35 is received by the indentation 38 so that substantially all of the lighting assembly 10 is contacting the mounting surface. As shown in FIG. 3*c*, the lighting assembly 10 can then be secured to the mounting surface using any of the methods described above including screws, nails, bolts, tape or any other suitable method. Lastly, any electrical connections or components can then be connected and/or installed by accessing the opposite side of the mounting surface, if necessary. An advantage of this installation method is that using the mounting bracket 33 allows the installation of the lighting assembly 10 to be performed by one person. Additionally, the mounting bracket 33 also provides structural support for the installed lighting assembly 10.

The lighting assembly 10 may also be configured to conserve energy. Aside from the usage of LEDs which operate using far less energy than conventional light fixtures, the lighting assembly 10 can be configured to run more energy and be cost efficient. In one embodiment, the lighting assembly 10 may be controlled by a motion or occupancy sensor, such that feedback or input signals from the sensors operates to control the emission of light from the lighting assembly 10. For example, when motion or occupancy is not sensed, the emission of light from all or some of the light emitting elements 23, 25, 27 can be reduced and/or turned off; whereas when motion or occupancy is sensed the light emitting elements 23, 25, 27 may return to full brightness or all the light emitting elements 23, 25, 27 may be turned on. These modes of lighting may be triggered by events other than motion or occupancy as well, such as a switch, timer, or any other suitable method. In addition, the lighting assembly 10 may comprise circuitry adapted to reduce or shut off the power to the lighting assembly 10 in the event that the operational temperature of the lighting assembly and/or the light emitting elements 23, 25, 27 exceeds a predetermined threshold in order to prevent damage to the lighting assembly 10 or its components.

The lighting assembly 10 may be used to replace an existing conventional light fixture such as those powered by fluorescent lights, neon, incandescent or metal halide. In order to make the replacement easier, the housing 12 of the lighting assembly 10 has a footprint greater than the footprint of the existing light fixture being replaced. As such the lighting assembly 10, when installed, covers the lines, discolorations, and other markings left behind by the existing light fixture. An advantage of the invention is that the lighting assembly 10 allows for a quick replacement without the need for further repairs or touch-up painting of the area around the newly installed lighting assembly 10.

Although the present invention has been described in considerable detail with reference to certain configurations thereof, other versions are possible. The lighting assembly according to the invention can be many different sizes, can be formed of different material and can be used in many different applications beyond down lighting applications. In other embodiments, a variable power supply can be used to control the intensity of the light emitting elements. Therefore, the spirit and scope of the invention should not be limited to the versions described above.

We claim:

1. A lighting assembly, comprising:

a housing including a front surface and a back surface;

a plurality of light emitting elements mounted within said housing;

a reflector adjacent said plurality of light emitting elements, wherein said reflector comprises a plurality of reflective cups;

said plurality of reflective cups arranged to form a plurality of reflective patterns, such that each of said plurality of reflective patterns is adapted to emit a respective light distribution pattern, wherein adjacent reflective patterns are arranged to be distinct.

2. The lighting assembly of claim 1, wherein each of said plurality of reflective cups comprises a reflector opening to receive a respective one of said plurality of light emitting elements.

3. The lighting assembly of claim 1, wherein said plurality of light emitting elements are mounted onto a printed circuit board (PCB).

4. The lighting assembly of claim 3, wherein said PCB is configured to be mounted to said back surface.

5. The lighting assembly of claim 1, further comprising first and second conductors electrically connected to said plurality of light emitting elements to provide an electrical signal.

6. The lighting assembly of claim 1, further comprising a cover coupled to said front surface of said housing, such that said cover is an emission surface of said lighting assembly.

7. The lighting assembly of claim 1, wherein said reflector is configured to be attached to said back surface of said housing.

8. The lighting assembly of claim 7, wherein said back surface comprises at least one mounting hole adapted to receive a screw, such that said screw extends into said housing through said mounting hole and is received by a respective mounting hole on said reflector.

9. The lighting assembly of claim 1, wherein said housing comprises a weather-proof seal at said front surface and at a junction where said front surface and said back surface are joined to form said lighting assembly.

10. The lighting assembly of claim 1, wherein said light emitting elements are light emitting diodes (LEDs).

11. The lighting assembly of claim 1, said housing further comprising a cover coupled to the front surface.

12. The lighting assembly of claim 11, wherein said cover is adapted to diffuse light emitted from said plurality of light emitting elements to give the appearance that said lighting assembly is a continuous light source.

13. A lighting assembly, comprising:

a housing including a front surface and a back surface;

a plurality of light emitting elements mounted within said housing;

a reflector adjacent said plurality of light emitting elements, wherein said reflector comprises a plurality of reflective cups;

said plurality of reflective cups arranged to form a plurality of reflective patterns, such that each of said plurality of reflective patterns is adapted to emit a respective light distribution pattern, wherein said plurality of reflective patterns are arranged in a concentric pattern.

14. The lighting assembly of claim 13, wherein said concentric pattern comprises an inner pattern, an intermediate pattern, and an outer pattern.

15. The lighting assembly of claim 14, wherein said reflective cups of said inner pattern have an angle opening greater than said reflective cups of the other of said patterns, such that said inner pattern is adapted to produce a wide light distribution pattern.

16. The lighting assembly of claim 13, wherein an angle opening of said reflective cups of each of said plurality of reflective patterns increases in size as said concentric patterns approach a central point of said reflector.

17. A lighting assembly, comprising:

a housing including a front surface and a back surface;

a plurality of light emitting elements mounted within said housing;

a reflector adjacent said plurality of light emitting elements, wherein said reflector comprises a plurality of reflective cups;

said plurality of reflective cups arranged to form a plurality of reflective patterns, such that each of said plurality of reflective patterns is arranged to be distinct and adapted to emit a respective light distribution pattern, wherein the light emission of said plurality of light emitting elements are adapted to be modified in response to a sensor.

18. The lighting assembly of claim 17, wherein said sensor is adapted to detect environmental conditions.

19. The lighting assembly of claim 18, wherein said sensor can be a motion sensor, occupancy sensor, operational temperature sensor, or a combination thereof.

20. A lighting assembly, comprising:

a housing including an emission surface;

a plurality of light emitting elements mounted within said housing;

a plurality of reflective patterns arranged within said housing, wherein said plurality of light emitting elements are configured to be aligned with said plurality of reflective patterns such that each one of said plurality of reflective patterns is adapted to reflect light emitted from a respective one of said plurality of light emitting elements, wherein adjacent reflective patterns are arranged to be distinct to produce a distinct light distribution pattern for each one of said plurality of reflective patterns.

21. The lighting assembly of claim 20, wherein said housing further comprises a back surface opposite the emission surface.

22. The lighting assembly of claim 20, wherein said plurality of reflective patterns is comprised of a reflector having a plurality of reflective cups, wherein a group of reflective cups forms one of said plurality of reflective patterns, such that said reflective cups within a specific group all have the same physical dimensions.

23. The lighting assembly of claim 22, wherein each group of reflective cups are shaped differently, such that each of the reflective patterns are adapted to provide distinct light distribution patterns.

24. The lighting assembly of claim 22, wherein said plurality of reflective patterns can be arranged in a concentric pattern, a linear pattern or a random pattern.

25. The lighting assembly of claim 20, wherein said plurality of light emitting elements are mounted on a printed circuit board (PCB) within said housing.

26. The lighting assembly of claim 25, wherein said PCB can be made of flexible material or rigid material.

27. The lighting assembly of claim 25, wherein said PCB is formed of a plurality of layered materials, wherein at least one of said plurality of layered materials is a thermally conductive layer and dissipates heat from said plurality of light emitting elements.

28. The lighting assembly of claim 27, wherein said PCB further comprises one or more thermal vias in thermal communication with said thermally conductive layer.

29. The lighting assembly of claim 20, wherein said lighting assembly is configured to be received by a mounting bracket, wherein said mounting bracket provides structural support for said lighting assembly.

30. The lighting assembly of claim 29, wherein said lighting assembly is mounted to a mounting surface so as to provide a down-light lighting scheme.

31. A lighting assembly, comprising:

a housing including an emission surface;

a plurality of light emitting elements mounted within said housing;

a plurality of reflective patterns arranged within said housing, wherein said plurality of light emitting elements are configured to be aligned with said plurality of reflective patterns such that each one of said plurality of reflective patterns is adapted to reflect light emitted from a respective one of said plurality of light emitting elements to produce a distinct light distribution pattern for each one of said plurality of reflective patterns, wherein each of said light distribution pattern for said plurality of reflective patterns overlap with one another such that said light assembly has a uniform light distribution pattern having a gradual drop-off of light at the edges of the uniform light distribution pattern.

32. A lighting assembly, comprising:

a housing including a light emitting surface, a back surface and a hinge slot;

a plurality of light emitting elements mounted on a printed circuit board (PCB), said PCB mounted within said housing;

a reflector disposed proximate said plurality of light emitting elements, said reflector comprising a plurality of reflective cups, wherein each reflective cup is adapted to receive a respective one of said plurality of light emitting elements;

a plurality of reflective patterns arranged to be comprised of a group of said plurality of reflective cups, wherein each one of said plurality of reflective patterns are arranged to be distinct and configured to produce an associated light distribution pattern; and a mounting bracket including at least one hinge extension, said hinge extension adapted to be received by said housing in order to mount said lighting assembly to a mounting surface.

33. The lighting assembly of claim 32, wherein said back surface is configured to attached said PCB and said reflector to said back surface.

34. The lighting assembly of claim 33, wherein said back surface and said PCB each have an opening aligned with each other such that a threaded extension extends into said housing through said opening and is received by a nut so that said nut can be used secure said PCB to said back surface.

35. The lighting assembly of claim 33, wherein said back surface, said PCB and said reflector each have at least one mounting hole aligned with each other such that a screw extends into said housing through said back surface, said PCB and is received by said mounting hole of said reflector, such that said reflector is attached said back surface.

36. The lighting assembly of claim 32, further comprising at least one heat sink in order to dissipate heat from said plurality of light emitting elements.

37. The lighting assembly of claim 36, further comprising thermal vias in said PCB and in thermal communication with said heat sink.

38. The lighting assembly of claim 32, wherein said group of reflective cups within a respective reflective pattern all have the same physical dimensions.

39. A lighting assembly, comprising:

a housing including a light emitting surface, a back surface and a hinge slot;

a plurality of light emitting elements mounted on a printed circuit board (PCB), said PCB mounted within said housing, further comprising an insulation sheet interposed between said PCB and said back surface;

a reflector disposed proximate said plurality of light emitting elements, said reflector comprising a plurality of reflective cups, wherein each reflective cup is adapted to receive a respective one of said plurality of light emitting elements;

a plurality of reflective patterns arranged to be comprised of a group of said plurality of reflective cups, wherein each one of said plurality of reflective patterns is configured to produce an associated light distribution pattern; and a mounting bracket including at least one hinge extension, said hinge extension adapted to be received by said housing in order to mount said lighting assembly to a mounting surface.

40. A lighting assembly, comprising:

a housing including a light emitting surface, a back surface and a hinge slot;

a plurality of light emitting elements mounted on a printed circuit board (PCB), said PCB mounted within said housing;

a reflector disposed proximate said plurality of light emitting elements, said reflector comprising a plurality of reflective cups, wherein each reflective cup is adapted to receive a respective one of said plurality of light emitting elements;

a plurality of reflective patterns arranged to be comprised of a group of said plurality of reflective cups, wherein each one of said plurality of reflective patterns is configured to produce an associated light distribution pattern; and a mounting bracket including at least one hinge extension, said hinge extension adapted to be received by said housing in order to mount said lighting assembly to a mounting surface;

wherein said housing comprises a hinge slot, such that said hinge slot is coupled to said hinge extension in order to assist in the installation of the lighting assembly.

41. A method of mounting a lighting assembly, comprising:

attaching a mounting bracket to a mounting surface, said mounting bracket comprising a hinge extension;

coupling a lighting assembly to said hinge extension of said mounting bracket, said lighting assembly comprising a hinge slot, such that said hinge slot is coupled to said hinge extension;

pivoting said lighting assembly about said hinge extension towards said mounting surface;

attaching said lighting assembly to said mounting surface, wherein an attachment device is used on a surface of said lighting assembly that is opposite said hinge extension; and attaching said lighting assembly to said mounting surface by utilizing said attachment device on a surface of said lighting assembly that is adjacent the hinge extension.

* * * * *